US007018222B2

(12) United States Patent
Chang

(10) Patent No.: US 7,018,222 B2
(45) Date of Patent: Mar. 28, 2006

(54) MEMORY CARD CONNECTOR WITH CARD EJECT MECHANISMS

(75) Inventor: Chia-Chen Chang, Hsin Chung (TW)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 11/128,001

(22) Filed: May 12, 2005

(65) Prior Publication Data

US 2005/0272291 A1 Dec. 8, 2005

(30) Foreign Application Priority Data

May 14, 2004 (TW) ..... 93207505 U

(51) Int. Cl.
*H01R 12/00* (2006.01)

(52) U.S. Cl. ..... 439/159

(58) Field of Classification Search ..... 439/159, 439/157, 630, 631
See application file for complete search history.

(56) References Cited

U.S. PATENT DOCUMENTS 6,482,020 B1 * 11/2002 Yeh ..... 439/159
6,599,142 B1 * 7/2003 Bu ..... 439/157
6,641,413 B1 * 11/2003 Kuroda ..... 439/159
6,669,493 B1 * 12/2003 Kuroda ..... 439/159
6,802,726 B1 * 10/2004 Chang ..... 439/159
6,817,875 B1 * 11/2004 Chang et al. ..... 439/159
6,913,492 B1 * 7/2005 Kuroda et al. ..... 439/631
2004/0110423 A1 * 6/2004 Shishikura et al. ..... 439/630

* cited by examiner

*Primary Examiner*—Tulsidas C. Patel
*Assistant Examiner*—Harshad C. Patel
(74) *Attorney, Agent, or Firm*—Charles S. Cohen

(57) ABSTRACT

A card eject system is provided for a memory card connector which includes a metal housing defining a receiving space for receiving a memory card inserted into the receiving space in an insertion direction through an insert opening generally at a front end of the housing. An insulating terminal socket is disposed at a rear end of the metal housing opposite the insert opening. A plurality of conductive terminals are mounted in the terminal socket for connection to the memory card. A pair of independently operable card eject mechanisms are disposed generally at opposite ends of the terminal socket for engaging the memory card at two spaced locations transversely of the insertion direction.

15 Claims, 5 Drawing Sheets

MEMORY CARD CONNECTOR WITH CARD EJECT MECHANISMS

FIELD OF THE INVENTION

This invention generally relates to the art of electrical connectors and, particularly, to a memory card connector having a plurality of card eject mechanisms.

BACKGROUND OF THE INVENTION

Memory cards are known in the art and contain intelligence in the form of a memory circuit or other electronic program. Some form of card reader reads the information or memory stored on the card. Such cards are used in many applications in today's electronic society, including video cameras, digital still cameras, smart phones, PDA's, music players, ATMs, cable television decoders, toys, games, PC adapters, multi-media cards and other electronic applications. Typically, a memory card includes a contact or terminal array for connection through a card connector to a card reader system and then to external equipment. The connector readily accommodates insertion and removal of the card to provide quick access to the information and program on the card. The card connector includes terminals for yieldingly engaging the contact array of the memory card.

The memory card connector often is mounted on a printed circuit board. The memory card, itself, writes or reads via the connector and can transmit between electrical appliances, such as a word processor, personal computer, personal data assistant or the like. With circuit board mounted connectors, the terminals of a connector include tail portions which are connected to appropriate circuit traces on the printed circuit board by various systems, such as surface mount technology where the tail portions are reflow soldered to the circuit traces. Through hole technology involves inserting the tail portions of the terminals into the holes in the printed circuit board for connection, as by soldering, to circuit traces on the board and/or in the holes.

FIG. 9 shows somewhat schematically a board mounted memory card connector, generally designated 12, for mounting on a printed circuit board according to the prior art and adapted for receiving existing memory cards. The connector includes a frame or housing, generally designated 14, having a front card-receiving end 16 and a rear end 18. The housing is molded of dielectric material such as plastic or the like and includes a pair of side walls 14*a* and 14*b* projecting forwardly from opposite ends of a rear terminal-mounting section 14*c*. A card-receiving space, generally designated 20, is formed between side walls 14*a* and 14*b* for receiving a memory card, generally designated 22, inserted into the connector in the direction of arrow "A". A card eject mechanism, generally designated 24, is mounted on side wall 14*b* and includes a push rod 24*a* pivotally connected to an ejection rod 24*b* which is pivoted to the rear terminal-mounting section 14*c* of the housing at pivot point 26. After memory card 22 is inserted into the card-receiving space 20, the card can be ejected by pushing on rod 24*a* in the direction of arrow "B" which, in turn, pivots a distal end of ejecting rod 24*b* in the direction of arrow "C" to at least partially eject the memory card from its fully connected position. Insertion of a memory card back into the connector restores the eject mechanism to its ejection condition as shown in full lines in FIG. 9.

One of the problems with card eject mechanisms of the prior art is their inability to apply uniform forces to the memory card during ejection, across the lateral leading edge of the card. Often, the card tends to become skewed during ejection, making the ejection process difficult or unreliable. Another problem is that prior art eject mechanisms take up too much room or area either on a printed circuit board or in electrical appliances within which the memory card connector is mounted. The present invention is directed to solving these problems.

SUMMARY OF THE INVENTION

An object, therefore, of the invention is to provide a memory card connector with a new and improved card eject mechanism.

In the exemplary embodiment of the invention, the memory card connector includes a metal housing defining a receiving space for receiving a memory card inserted into the receiving space in an insertion direction through an insert opening generally at a front end of the housing. An insulating terminal socket is disposed at a rear end of the metal housing opposite the insert opening. A plurality of conductive terminals are mounted in the terminal socket for connection to the memory card. A pair of independently operable card eject mechanisms are disposed generally at opposite ends of the terminal socket for engaging the memory card at two spaced locations transversely of the insertion direction.

According to one aspect of the invention, each of the card eject mechanisms comprises a push/push type eject mechanism. Each mechanism includes a body, a cam slider slidably mounted on the body and having a cam slot, a cam follower operatively associated with the cam slider and a spring for biasing the cam slider in an ejection direction opposite the insertion direction. Each cam slider of each eject mechanism has a front face for engaging the memory card generally at a leading corner of the card.

According to another aspect of the invention, the front end of the metal housing is wider than the rear end thereof, whereby the card-receiving space is generally L-shaped in a horizontal plane. The terminal socket is located at the narrower rear end of the metal housing. The card eject mechanisms are located at opposite sides of the narrower rear end of the metal housing.

According to a further aspect of the invention, the insulating terminal socket and the card eject mechanisms are parts of a unitary structure formed by a transverse terminal-mounting section and a pair of side wing sections integral with opposite ends of the transverse terminal-mounting section. The terminal-mounting section defines the insulating terminal socket, and the integral side wing sections define the bodies for the card eject mechanisms in a unitary structure.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
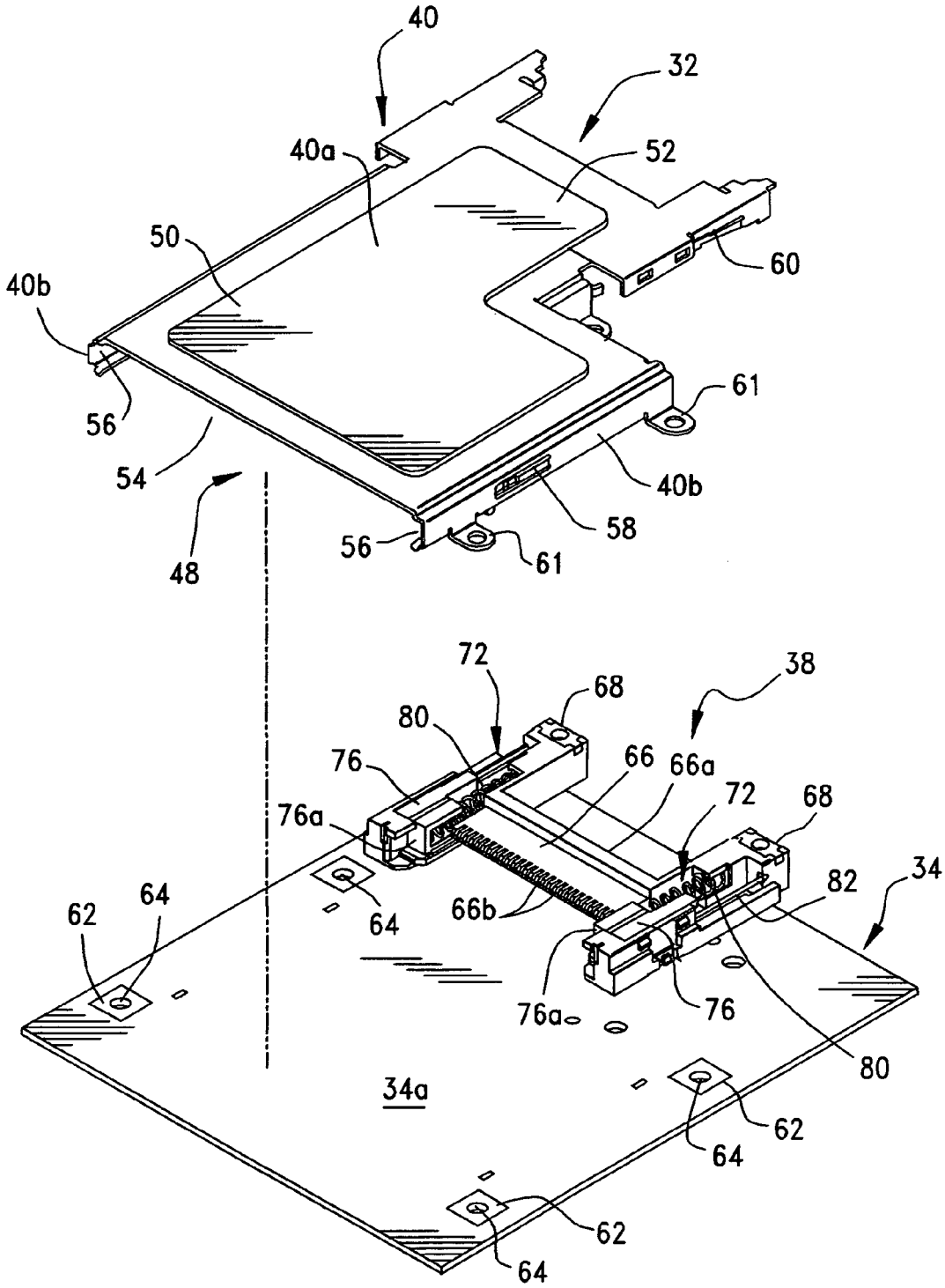
FIG. 1 is an exploded perspective view of a memory card connector according to the invention, mounted on a printed circuit board.
Figure 2:
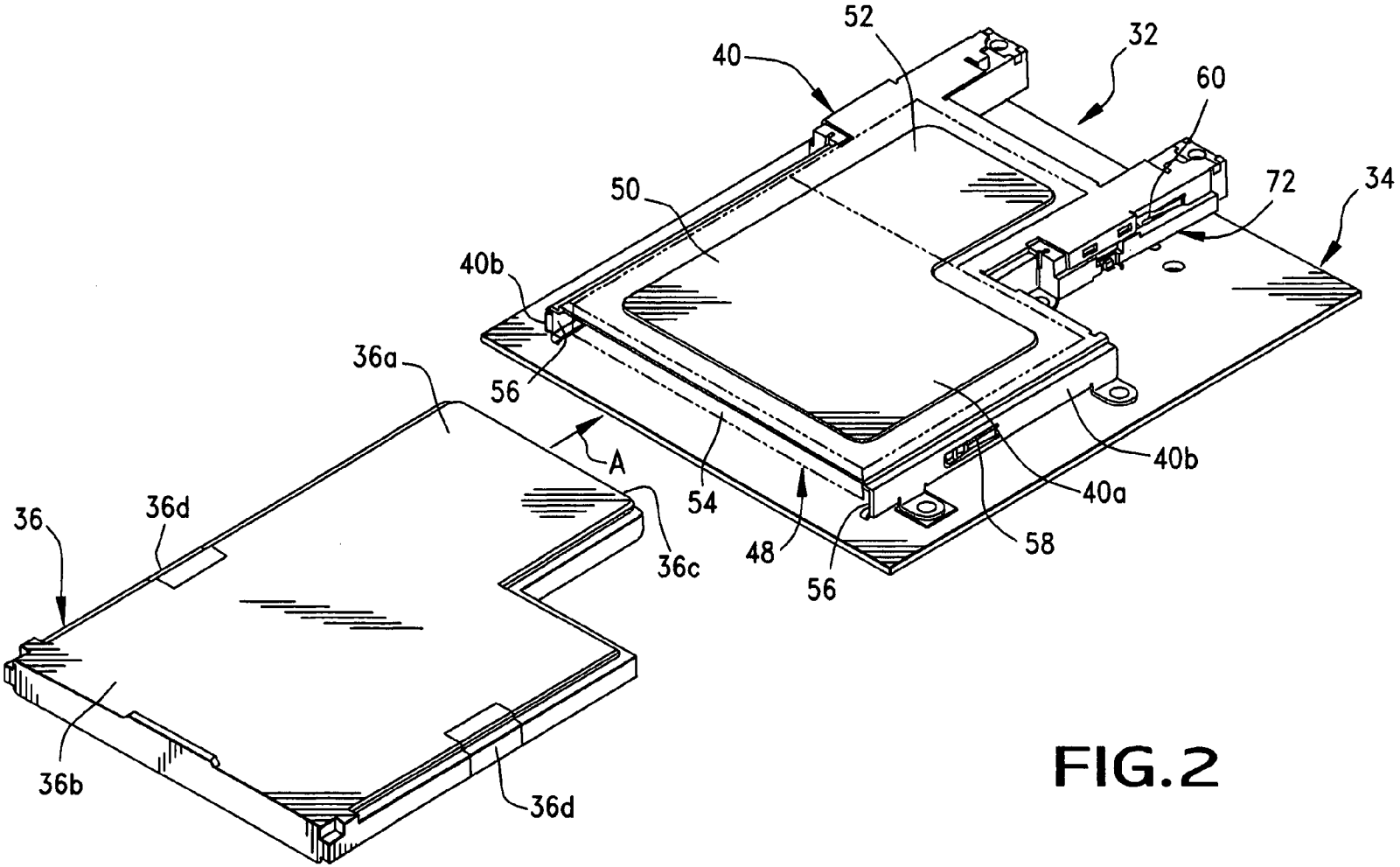
FIG. 2 is a perspective view of the connector in assembled condition and mounted on the circuit board, in conjunction with an ExpressCard type memory card.

Referring to the drawings in greater detail, and first to FIGS. 1 and 2, the invention is embodied in a memory card connector, generally designated 32, for mounting on a printed circuit board, generally designated 34. The connector receives a memory card, generally designated 36, inserted into the connector in the direction of arrow "A" (FIG. 2). The connector includes an interior, unitary structure, generally designated 38, and an outer, shielding metal housing, generally designated 40.

Metal housing 40 is stamped and formed of conductive sheet metal material and includes a top wall 40*a* and a pair of side walls 40*b* which define a card-receiving space, generally designated 48, therebetween. The metal housing has a wider front end portion 50 and a narrower rear end portion 52, whereby card-receiving space 48 is generally L-shaped in a horizontal plane. Of course, the term "horizontal" is not meant to be limiting but is descriptive of the depiction in the drawings. A front insert opening 54 is formed at the front of metal housing 40 between side walls 40*b* thereof. Guide grooves 56 are formed in the insides of side walls 40*b* of the metal housing. A flexible grounding finger 58 is stamped and formed out of each side wall 40*b* and projects inwardly therefrom, for purposes to be described below. A spring finger 60 is stamped and formed out of each side of the narrower rear end portion 52 of the housing, again for purposes described below. Finally, a plurality of grounding tabs 61 project outwardly from side walls 40*b* of the metal housing.

Before proceeding, and referring specifically to FIG. 2, memory card 36 is according to the ExpressCard specification. Consequently, the memory card includes a narrower leading end portion 36*a* and a wider trailing end portion 36*b*, which matches the L-shaped horizontal configuration of metal housing 40 as the memory is inserted into the connector in the direction of arrow "A". Leading end portion 36*a* had a leading edge 36*c* which has a socket (not visible in the drawings) within which a plurality of appropriate contacts are exposed for engaging contact portions of terminals described hereinafter. A pair of ground contacts 36*d* are disposed at opposite sides of memory card 36 for engaging the flexible grounding fingers 58 of metal housing 40.

Printed circuit board 34 has a plurality of ground pads 62 on a top surface 34*a* of the circuit board. A through hole 64 extends through the circuit board and through each ground pad 62 for receiving a fastener which is inserted upwardly through the hole and through the ground pad and into a respective one of the grounding tabs 61 of metal housing 40. This rigidly secures the housing to the circuit board.

Unitary structure 38 includes a terminal-mounting section 66 and a pair of side wing sections 68 which comprises a one-piece or unitary structure which may be integrally molded of dielectric material such as plastic or the like. The terminal-mounting section extends transversely or generally perpendicular to insertion direction "A" and forms an insulating terminal socket 66 for the connector. The terminal socket has a rear edge 66*a* and a plurality of terminal-receiving passages 66*b* opening at the front of the terminal socket. A plurality of conductive terminals, generally designated 70 (FIG. 3), are mounted in the terminal socket. The terminals include contact portions within passages 66*b* for engaging the contacts of the memory card. The terminals have tail portions 70*a* for connection, as by soldering, to appropriate circuit traces on top surface 34*a* of printed circuit board 34.

Figure 3:
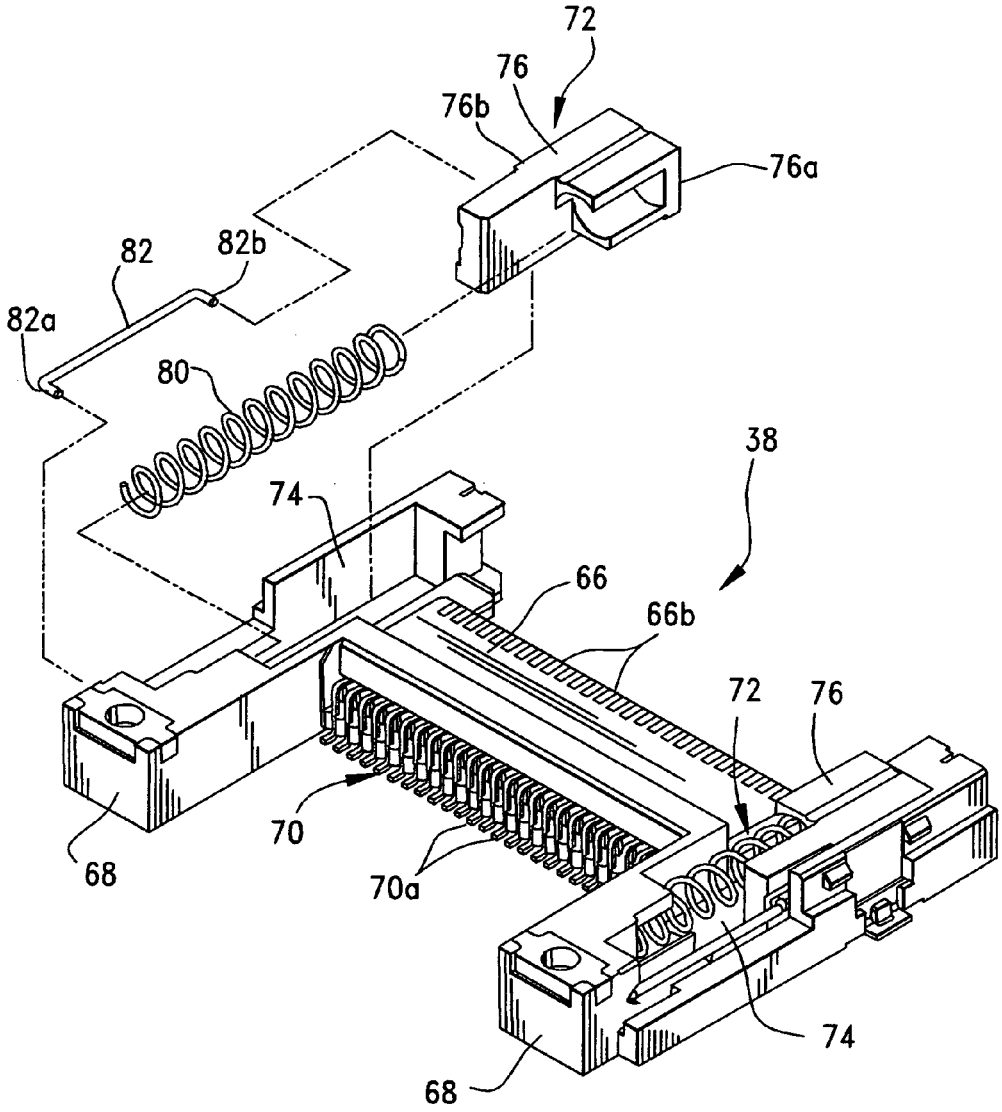
FIG. 3 is an enlarged perspective view of the unitary structure which forms the terminal socket and the bodies of the eject mechanisms, with one of the eject mechanisms shown in exploded condition.
Figure 4:
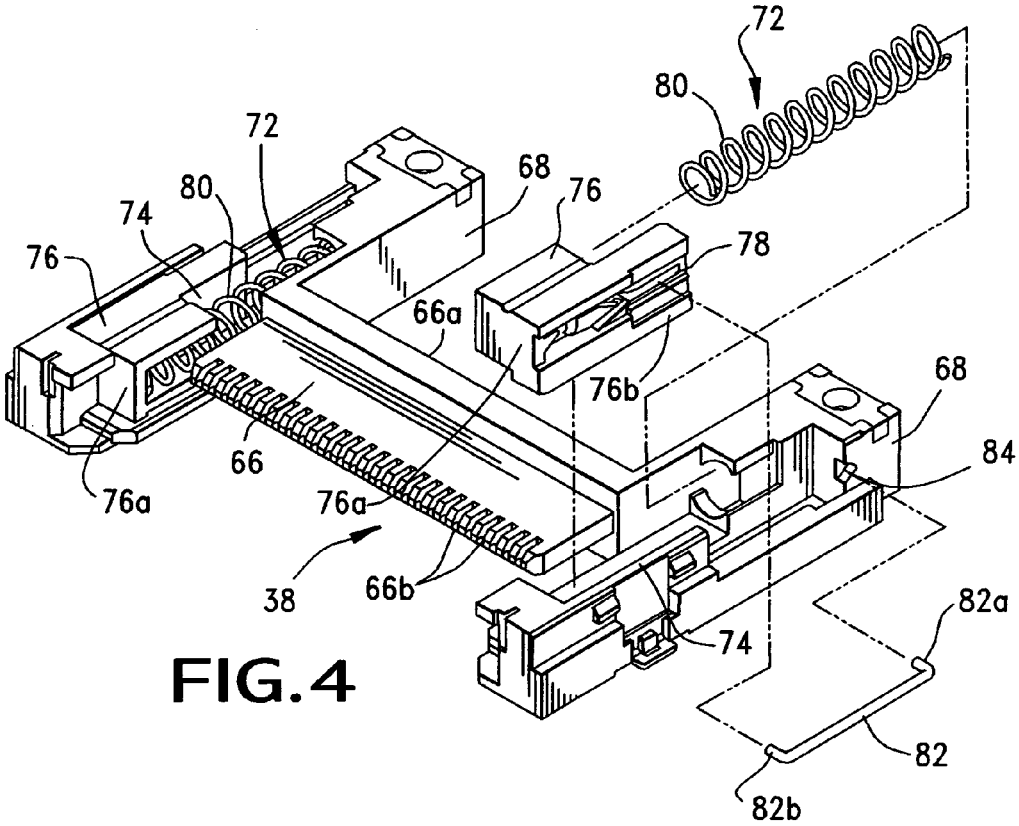
FIG. 4 is a view similar to that of FIG. 3, with the other eject mechanism shown in exploded condition.

Referring to FIGS. 3 and 4 in conjunction with FIGS. 1 and 2, side wing sections 68 of unitary structure 38 form the bodies of a pair of independently operable card eject mechanisms, generally designated 72, of the push/push type. Each card eject mechanism is totally independent of the other eject mechanism so that the two eject mechanisms apply independent ejection forces on the memory card, particularly at opposite side front edges or corners of the card, as will be seen hereinafter. This facilitates ejecting the memory card without the card becoming skewed or binding within the card-receiving space defined by metal housing 40. In essence, card eject mechanisms 72 are provided at opposite ends of terminal socket 66.

More particularly, the body of each card eject mechanism, formed by the respective side wing section 68, includes a translating groove 74 for receiving a cam slider 76 as is known in the art of such push/push cam eject mechanisms. In other words, the translating groove extends in a front-to-rear direction so that cam slider 76 is slidably movable within the groove generally parallel to the insertion direction indicated by "A" in FIG. 2. The cam slider includes a front ejecting face 76*a* and an outside face 76*b*. A heart-shaped cam groove 78 is formed in outside face 76*b* of the cam slider, the groove having a known configuration. A coil spring 80 is sandwiched between cam slider 76 and body 68 to constantly bias the cam slider forwardly in an ejection direction. A generally U-shaped cam follower 82 includes opposite hook ends 82*a* and 82*b*. End 82*a* is fixed within a hole 84 (FIG. 4) of body 68, and hook end 62*b* rides within cam groove 78. Spring fingers 80 of metal housing 40 engage cam followers 82 and constantly bias hook ends 82*b* of the cam followers into cam grooves 78 for movement therewithin according to the push/push action.

Figure 5:
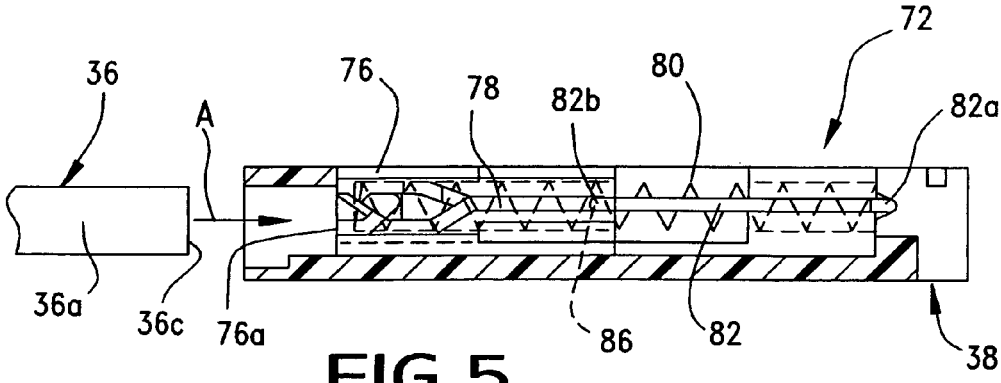
FIGS. 5–8 are front-to-rear sectional views through one of the card eject mechanisms and showing sequential depictions in the action of the push/push mechanism.

FIGS. 5–8 show how card eject mechanisms 72 operate sequentially in response to insertion of memory card 36 into card-receiving space 48 of connector 32. These drawings show only one of the eject mechanisms but it should be understood that the following descriptions of the one eject mechanism applies to both eject mechanisms. FIG. 5 basically shows the initial or "card-out" position of the memory card relative to the connector. In this position, cam slider 76 is biased forwardly by coil spring 80. The memory card is inserted in the direction of arrow "A" until leading edge 36*c* of the narrower leading end portion 36*a* of the memory card abuts front ejecting face 76*a* of the cam slider. Hook end 82*b* of cam follower 82 is located at a first position 86 of the heart-shaped cam groove 78 at the rear of the cam groove.

Figure 6:
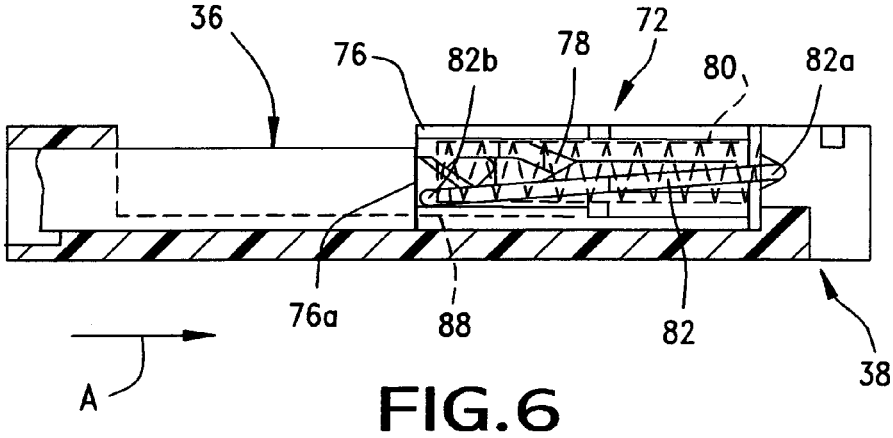
Figure 7:
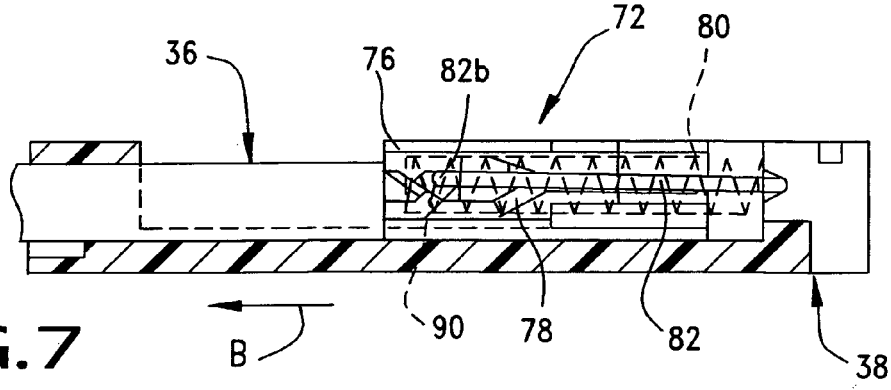

FIG. 6 shows memory card 36 pushed inwardly in the direction of arrow "A", pushing cam slider 76 therewith. With end 82*a* of cam follower 82 fixing the cam follower to body 68, hook end 82*b* of the cam follower rides forwardly within cam groove 78 to a sort of overrun position within the cam groove, as indicated at 88 in FIG. 6. Upon removal of the pushing forces on memory card 36, coil spring 80 is effective to bias cam slider 76 and the memory card back outwardly in the direction of arrow "B", slightly to a stopped or locked position as shown at 90 in FIG. 7, as defined by the interengagement of hook end 82*b* of cam follower 82 within cam groove 78. The cam slider and memory card are stopped at this point as is known in the art of such push/push eject mechanisms which include heart-shaped cam grooves. In the locked position of the card as shown in FIG. 7, appropriate contacts on the card engage the contact portions of terminals 70.

Figure 8:
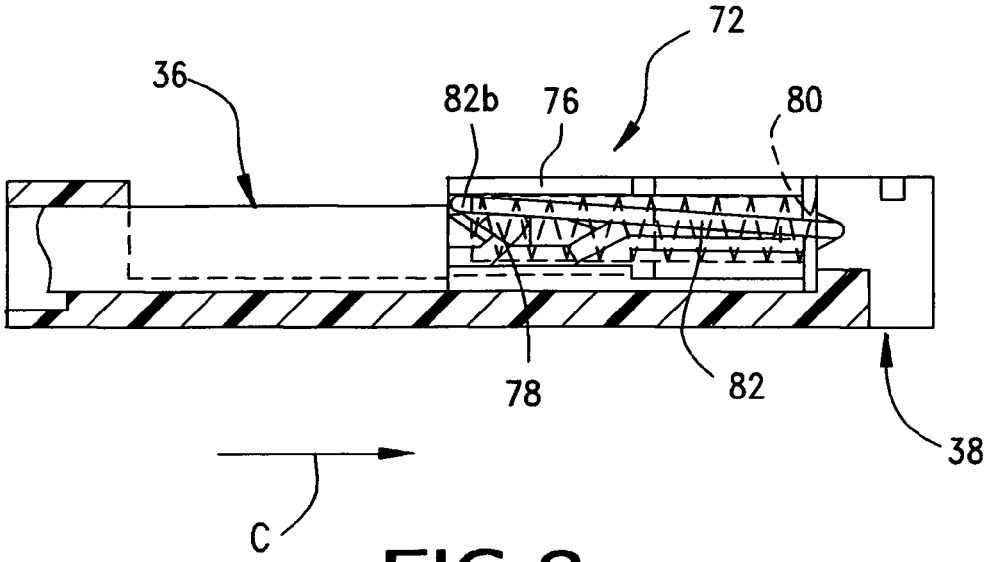
Figure 9:
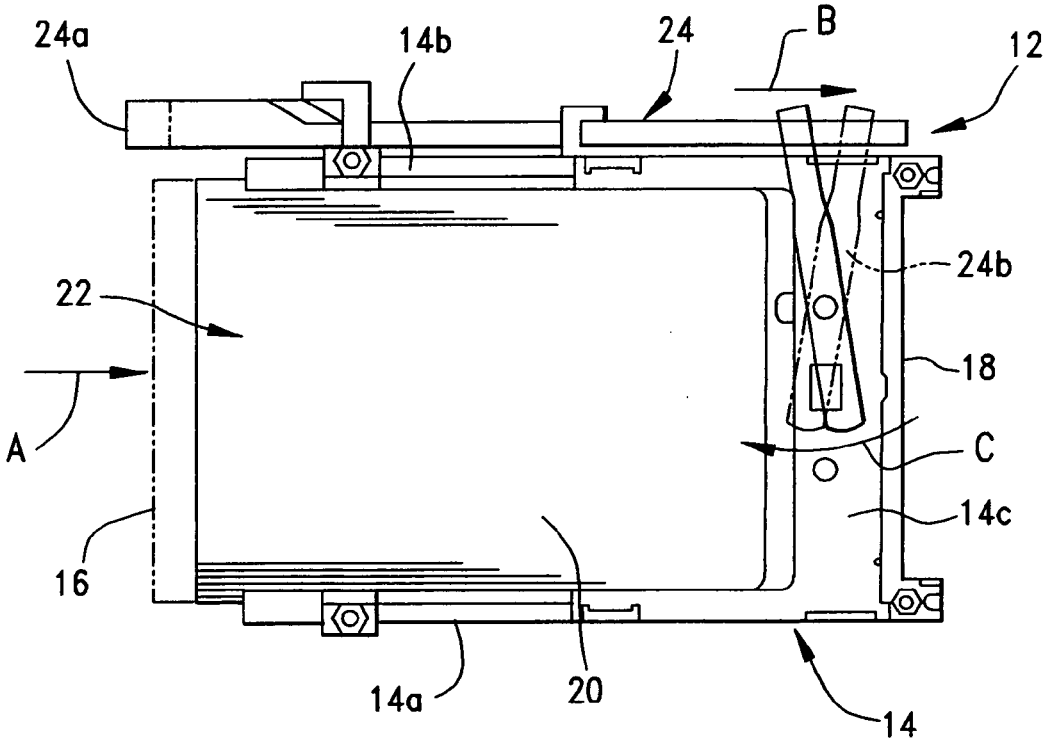
FIG.9 (PRIOR ART)
FIG. 9 is a top plan view of the prior art connector described in the Background, above.

When it is desired to eject the memory card, the card is pushed back inwardly a second time in the direction of arrow "C" as shown in FIG. 8, whereupon the locked condition of the card is released as hook end 82*b* of cam follower 82 moves along the cam groove, and whereupon coil spring 80 is effective to eject the card back to its "card-out" position and allow the card to be withdrawn from the card-receiving space 48 of the connector.

All of the push/push actions described above in relation to FIGS. 5 and 8 which show a single card eject mechanisms 72, is applicable for both card eject mechanisms at opposite ends of terminal socket 66. Both mechanisms operate independently of each other and apply independent forces at the opposite corners of leading edge 36*c* of memory card 36*c*, as the front ejecting faces 76*a* of the two independent cam sliders 76 engage the two opposite corners of the memory card.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A card eject system for a memory card connector, comprising:

a metal housing defining a receiving space for receiving a memory card inserted into the receiving space in an insertion direction through an insert opening generally at a front end of the housing;

an insulating terminal socket at a rear end of the metal housing opposite said insert opening;

a plurality of conductive terminals mounted in the insulating terminal socket for connection to the memory card; and a pair of independently operable card eject mechanisms generally at opposite ends of the insulating terminal socket for engaging the memory card at two spaced locations transversely of said insertion direction.

2. The card eject system of claim 1 wherein each of said card eject mechanisms comprises a push/push type eject mechanism.

3. The card eject system of claim 2 wherein each of said card eject mechanisms includes a body, a cam slider slidably mounted on the body and having a cam groove, a cam follower operatively associated with the cam slider and a spring for biasing the cam slider in an ejection direction opposite said insertion direction.

4. The card eject system of claim 3 wherein each cam slider of each eject mechanism has a front face for engaging the memory card generally at a leading corner of the card.

5. The card eject system of claim 1 wherein the front end of said metal housing is wider than the rear end thereof whereby said receiving space is generally L-shaped in a horizontal plane.

6. The card eject system of claim 5 wherein said insulating terminal socket is located at the narrower rear end of the metal housing.

7. The card eject system of claim 6 wherein said card eject mechanisms are located at opposite sides of the narrower rear end of the metal housing.

8. The card eject system of claim 1 wherein said insulating terminal socket and said card eject mechanisms are parts of a unitary structure formed by a transverse terminal-mounting section defining the insulating terminal socket and a pair of side wing sections integral with opposite ends of said transverse terminal-mounting section defining bodies for the card eject mechanisms.

9. The card eject system of claim 8 wherein each of said card eject mechanisms comprises a push/push type eject mechanism.

10. The card eject system of claim 9 wherein each of said card eject mechanisms includes a cam slider slidably mounted on the respective body and having a cam groove, a cam follower operatively associated with the cam slider and a spring for biasing the cam slider in an ejection direction opposite said insertion direction.

11. The card eject system of claim 10 wherein each cam slider of each eject mechanism has a front face for engaging the memory card generally at a leading corner of the card.

12. A card eject system for a memory card connector which includes a receiving space for receiving a memory card inserted into the receiving space in an insertion direction through an insert opening generally at a front end of the connector;

an insulating terminal socket at a rear end of the receiving space opposite said insert opening;

a plurality of conductive terminals mounted in the insulating terminal socket for connection to the memory card;

a pair of independently operable card eject mechanisms generally at opposite ends of the insulating terminal socket for engaging the memory card at two spaced locations transversely of said insertion direction; and wherein said insulating terminal socket and said card eject mechanisms being parts of a unitary structure formed by a transverse terminal-mounting section defining the insulating terminal socket and a pair of side wing sections integral with opposite ends of said transverse terminal-mounting section defining bodies for the card eject mechanisms.

13. The card eject system of claim 12 wherein each of said card eject mechanisms comprises a push/push type eject mechanism.

14. The card eject system of claim 13 wherein each of said card eject mechanisms includes one of said bodies, a cam slider slidably mounted on the body and having a cam groove, a cam follower operatively associated with the cam slider and a spring for biasing the cam slider in an ejection direction opposite said insertion direction.

15. The card eject system of claim 14 wherein each cam slider of each eject mechanism has a front face for engaging the memory card generally at a leading corner of the card.

* * * * *